US007100883B2

(12) United States Patent
Ramey, III et al.

(10) Patent No.: US 7,100,883 B2
(45) Date of Patent: Sep. 5, 2006

(54) DOCUMENT HOLDER FOR COMPUTER WORKSTATION

(75) Inventors: Thomas B. Ramey, III, Tyler, TX (US); Clifford T. Calfee, Richardson, TX (US)

(73) Assignee: Vu Ryte, Inc., Tyler, TX (US)

( * ) Notice: Subject to any disclaimer, the term of this patent is extended or adjusted under 35 U.S.C. 154(b) by 0 days.

(21) Appl. No.: 10/387,797

(22) Filed: Mar. 13, 2003

(65) Prior Publication Data

US 2004/0178317 A1 Sep. 16, 2004

(51) Int. Cl.
*B41J 11/02* (2006.01)

(52) U.S. Cl. ..... 248/442.2; 248/918; 248/447; 248/448; 248/449

(58) Field of Classification Search ..... 248/918, 248/441.1, 442.2, 446, 451, 452, 448, 449, 248/447; 400/718
See application file for complete search history.

(56) References Cited

U.S. PATENT DOCUMENTS

| | | | | | |
|---|---|---|---|---|---|
| 1,253,568 | A | * | 1/1918 | Bartlett | 248/447 |
| 1,627,350 | A | * | 5/1927 | Steinman | 248/451 |
| 2,317,821 | A | * | 4/1943 | Stein | 248/638 |
| 3,114,215 | A | * | 12/1963 | Turkin | 248/449 |
| 3,198,475 | A | * | 8/1965 | Flahive | 248/445 |
| 3,304,045 | A | * | 2/1967 | Bethoney | 248/451 |
| 4,023,524 | A | * | 5/1977 | Goldfarb et al. | 118/301 |
| 4,165,856 | A | * | 8/1979 | Wiseheart | 248/449 |
| 4,285,532 | A | * | 8/1981 | Davis | 281/42 |
| 4,635,893 | A | * | 1/1987 | Nelson | 248/558 |
| 4,893,775 | A | * | 1/1990 | Long | 248/442.2 |
| 5,104,086 | A | | 4/1992 | Ramey, III. et al. | |
| 5,246,251 | A | * | 9/1993 | Evans | 281/42 |
| 5,366,197 | A | * | 11/1994 | Westland | 248/456 |
| 5,443,237 | A | * | 8/1995 | Stadtmauer | 248/441.1 |
| 5,651,524 | A | | 7/1997 | Calfee | |
| 5,769,369 | A | * | 6/1998 | Meinel | 248/176.1 |
| 5,797,578 | A | * | 8/1998 | Graffeo et al. | 248/453 |
| 5,855,329 | A | * | 1/1999 | Pagano | 248/451 |
| 6,042,075 | A | * | 3/2000 | Burch, Jr. | 248/442.2 |
| 6,095,612 | A | * | 8/2000 | Man | 297/452.33 |
| D437,600 | S | | 2/2001 | Calfee | |

* cited by examiner

*Primary Examiner*—Kimberly Wood
*Assistant Examiner*—Steven Marsh
(74) *Attorney, Agent, or Firm*—Gardere Wynne Sewell, LLP

(57) ABSTRACT

A document holder, adapted for use at a computer workstation or word processor, includes an easel supported by spaced apart support arms. The easel and the support arms are connected to each other at respective pivot connections to provide for angular adjustment of the easel with respect to the arms. The easel includes a first member connected to the support arms and a second member which is movable relative to the first member in a downward direction or a direction toward an operator of the document holder. The first and second easel members include respective retainer and support rail parts provided with detents for selectively locking the second easel member in a selected working position with respect to the first easel member. A third easel member is supported on the first easel member for extension in a direction opposite that of the second easel member.

10 Claims, 11 Drawing Sheets

DOCUMENT HOLDER FOR COMPUTER WORKSTATION

BACKGROUND OF THE INVENTION

Document holders have been developed for use with computer workstations and word processing equipment with a view to providing ergonomically correct support for documents being viewed by the operator of a computer or word processor, for example. Examples of improvements in document holders for workstations are the subject of U.S. Pat. Nos. 5,104,086 and 5,651,524. Document holders which can be placed directly in front of a workstation monitor are advantageous for the reasons described in the above-mentioned patents. However, in addition to providing a document holder which may be positioned directly in front of a workstation monitor or directly behind a keyboard, it has been determined that, typically, the space between a computer monitor and a keyboard, for example, may be more advantageously utilized by a document holder which is adapted to undergo angular adjustment as well as providing a document support ledge or flange which may be adjusted downwardly and/or toward the keyboard operator.

In this way, a document supported by the holder may be brought into a more suitable viewing range for the operator of the workstation and the space between the workstation monitor and the keyboard may be better utilized without the document or the document holder interfering with the operator's ability to view the monitor video screen, for example. Moreover, in many instances where a workstation table has a keyboard support or tray disposed below the edge of the table, or surface which supports the monitor, a document holder which has a downwardly adjustable document support lip or flange may even more efficiently utilize available space for supporting a document in a preferred position for the workstation operator. It is to these ends that the present invention has been developed.

SUMMARY OF THE INVENTION

The present invention provides an improved document holder, particularly adapted for use with a computer workstation, word processing equipment or other arrangements wherein an operator requires a support for a document while working at a computer or word processor keyboard.

In accordance with one important aspect of the present invention, an improved document holder is provided which is adapted to be mounted directly in front of a computer monitor screen and between the screen and a keyboard and to more effectively utilize space within a desired location for a document to be viewed by a workstation or a word processor operator.

In accordance with a preferred embodiment of the invention, the improved document holder includes a multipart easel supported by two spaced apart support arms which may, for example, rest on a horizontal surface and are connected to the easel by adjustable pivot connections to vary the angle formed between the document support surface of the easel and the document holder support surface.

In accordance with a particularly important aspect of the invention, a document holder is provided which includes an easel including a first member which is connected to spaced apart support arms and a second member which is adjustable with respect to the first member in one direction generally downwardly and generally toward the workstation operator. The second easel member preferably includes a support lip or flange for supporting the lower edge of a document on the document holder. In this way, documents of various sizes may be easily supported by the document holder without interfering with the operator's ability to view the entire workstation or word processor monitor screen. Still further, the easel includes a third member which is adjustable in an opposite direction or upwardly with respect to the first member to assist in supporting relatively large documents. The second and third movable members of the easel may be easily adjusted and secured in respective desired positions by cooperating detent and support leg structure for connecting the second member to the first member and by a snug friction fit between the third member and corresponding supporting portions of the first member. The second and third easel members are easily slidable to adjust the easel for accommodating documents of different sizes while the movable members of the easel also remain fixed during normal use once their position has been adjusted.

The present invention includes additional features which offer advantages. Easy manual adjustment between the document holder support arms and the easel is provided by a pivot connection between each of the support arms and the easel. The support arms are provided with counterweights at their distal ends and non-skid support feet mounted thereon for causing the document holder to remain in a desired working position. At least one of the easel members includes a dry eraser type message or note board and a receptacle for holding notepads whereby messages or notes may be conveniently placed on the message board, and notepad sheets are readily accessible when needed.

Still further advantages provided by the present invention include alternate embodiments wherein bosses or support brackets for connecting the easel to document holder support arms may be selectively mounted on the easel in alternate positions and other embodiments of support arms may be used in conjunction with the easel to provide a versatile document holder.

The above-mentioned features and advantages of the present invention will be further appreciated by those skilled in the art upon reading the detailed description which follows in conjunction with the drawings.

BRIEF DESCRIPTION OF THE DRAWINGS

FIG. 1 is a perspective view of a document holder in accordance with the invention shown in a working position at a computer workstation or the like;

DETAILED DESCRIPTION OF THE PREFERRED EMBODIMENTS

Figure 1:
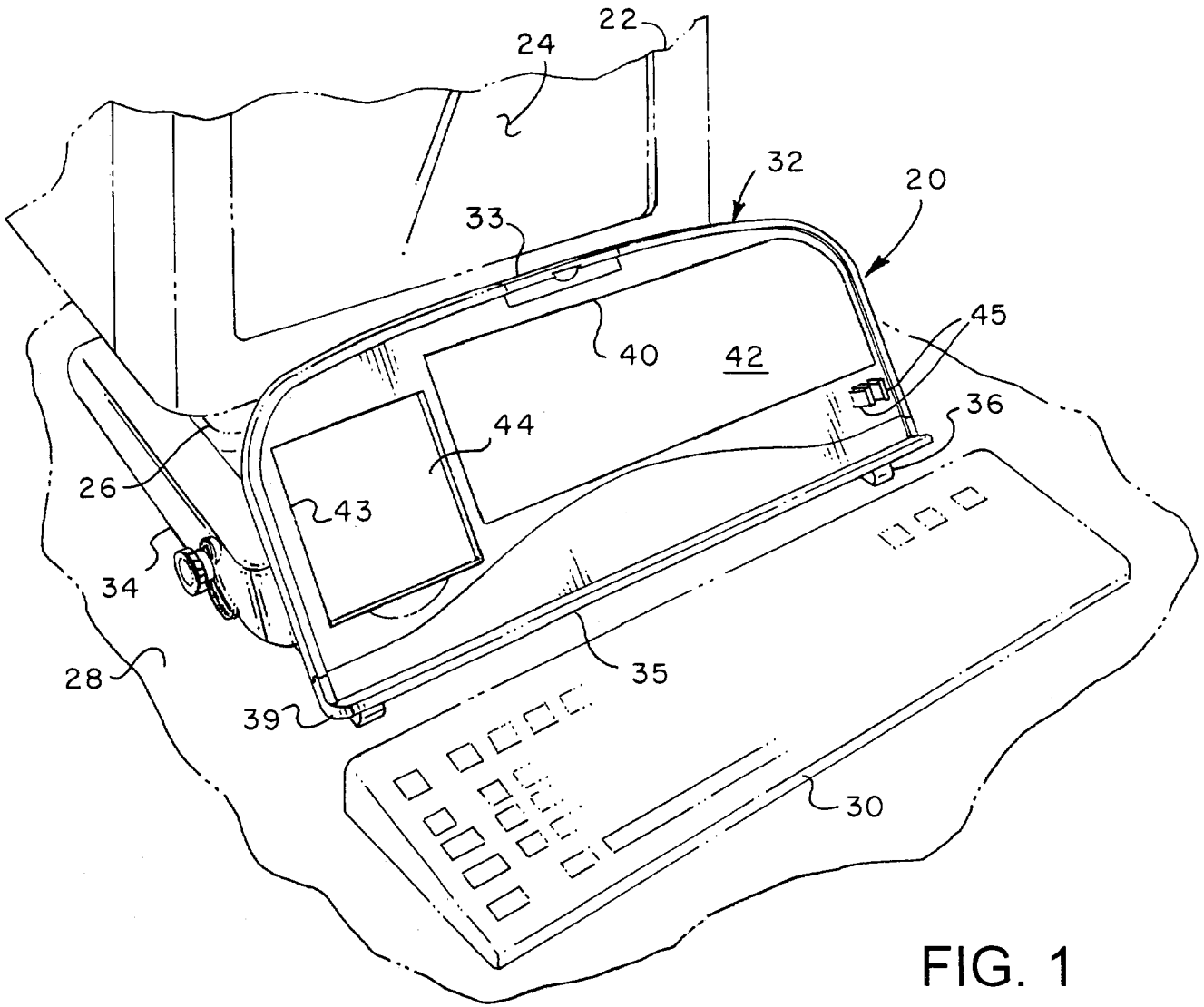

In the description which follows like parts are marked throughout the specification and drawing with the same reference numerals, respectively. The drawing figures may not necessarily be to scale and certain features may be exaggerated in scale in the interest of clarity and conciseness.

Referring to FIG. 1, there is illustrated a document holder in accordance with the invention and generally designated by the numeral 20. The document holder 20 is shown in use in combination with a computer workstation or word processor including a computer or word processor video monitor unit 22 having a video screen 24 and mounted on a suitable support base 26. The support base 26 rests on a table or a desktop surface 28 and which is generally horizontal. The surface 28 may or may not be adapted to support a keyboard 30, that is, the keyboard may also rest on a generally horizontal shelf or tray, not shown, in a position generally below the surface 28, as will be recognized and appreciated by those skilled in the art.

Document holder 20 includes a generally planar easel 32 and two, opposed, spaced apart support arms 34 and 36 which are spaced apart sufficiently to extend on opposite sides of the support base 26. A suitable support base 26 may be of a type as shown and claimed in U.S. Pat. Nos. 5,685,441; D390,546 and D399,834, all assigned to the assignee of the present invention. The easel 32 is connected to the arms 34 and 36 by respective pivot connections which permit angular adjustment of the easel with respect to the surface 28 and an operator, not shown, facing keyboard 30 and viewing monitor screen 24. In this way a preferred document viewing angle may be set by an operator when viewing a document supported by the document holder 20.

Figure 2:
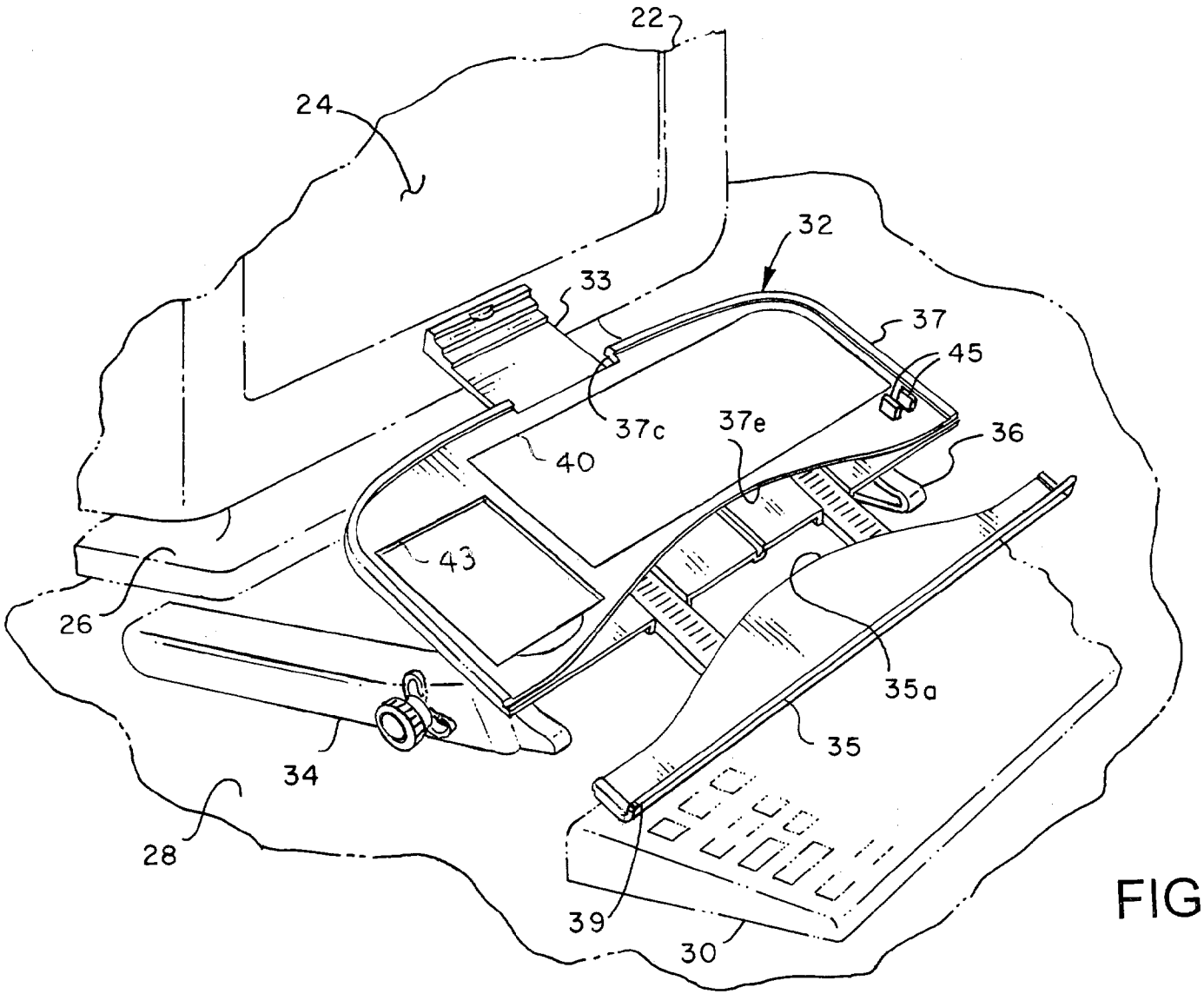
FIG. 2 is a perspective view similar to FIG. 1 but showing the adjustable easel members extended to support relatively large documents.

Moreover, as shown in FIG. 2, the easel 32 includes movable easel members 33 and 35 which are movable relative to an easel member 37 in opposite directions, the easel member 37 being directly connected to the arms 34 and 36 through the aforementioned pivot connections. Movable easel member 35 includes a transverse lip, ledge or flange 39 and forms a lower document support part of the easel 32 and which is downwardly and forwardly adjustable toward the workstation operator to accommodate relatively large documents and/or to support a document for a better viewing position with respect to the workstation operator. Of course, upwardly or rearwardly adjustable easel member 33 is also operable to assist in supporting a document which is relatively large with respect to the easel 32.

Referring further to FIGS. 1 and 2, the document holder 20 also advantageously includes an elongated, generally rectangular recess 40 formed in the easel member 37 for supporting a dry erase message pad 42 therein whereby erasable messages or notes may be written on the pad in a convenient position for viewing by the workstation operator. Still further, the easel member 37 includes a second recess 43 adjacent the recess 40 for receiving a notepad 44, for example. In this way the document holder 20 is not only advantageous with respect to its versatility in supporting various sizes of documents in a preferred location for an operator of a workstation or word processor having a video monitor and a keyboard, such as the monitor 22 and keyboard 30, but the document holder 20 also assists an operator in remaining organized and having items at hand for jotting down messages, notes and other bits of information easily and conveniently. A pen or pencil holder or clip may be molded on easel member 37, as shown in FIGS. 1 and 2, and comprising closely spaced bosses 45.

Figure 3:
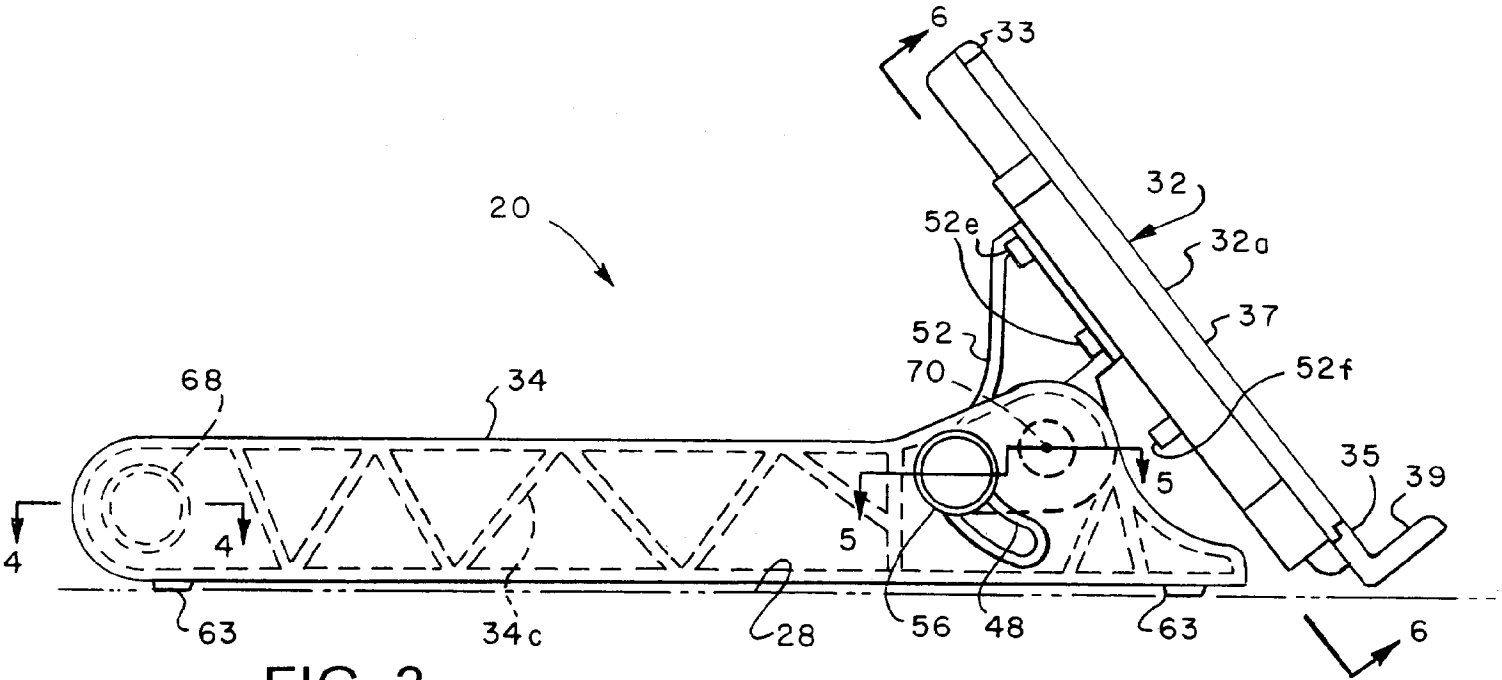
FIG. 3 is a side elevation of the document holder shown in FIGS. 1 and 2.
Figure 4:
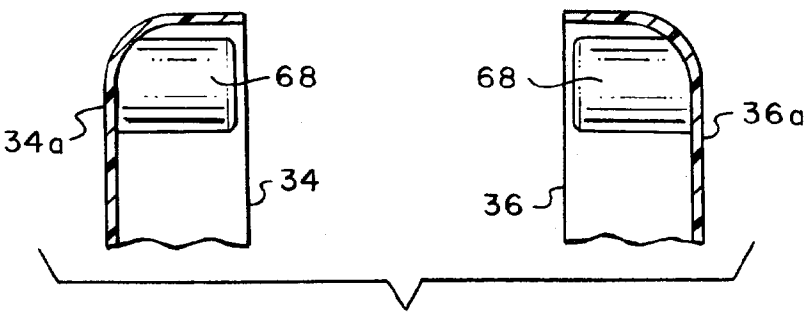
FIG. 4 is a detail section view taken generally along the line 4—4 of FIG. 3.
Figure 5:
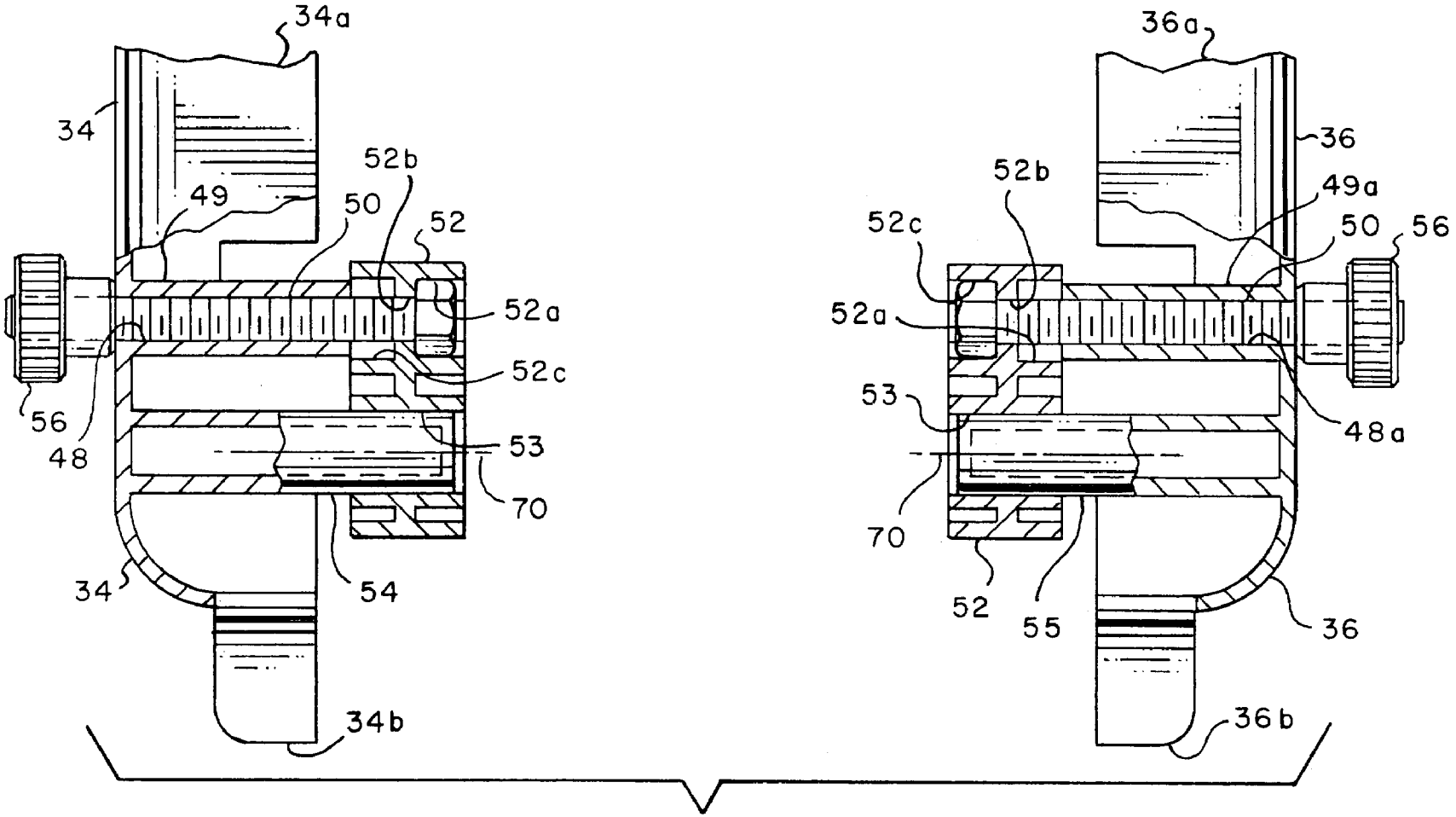
FIG. 5 is a detail section view taken generally along the line 5—5 of FIG. 3.

Referring now to FIGS. 3, 4 and 5, and FIG. 3 in particular, the elongated support arm 34 is provided with a somewhat arcuate slot 48 formed therein for receiving a lock pin 50, see FIG. 5, which is supported by a boss or support bracket 52 connected to the easel 32. As shown in FIG. 5, slot 48 is defined by a boss 49 formed integral with arm 34. Boss or support bracket 52 also includes a pivot pin bearing bore 53 for receiving an elongated cylindrical pivot pin 54 also integrally formed with arm 34 and disposed in bore 53 for pivotal movement whereby the document support surface 32*a*, FIG. 3, of easel 32 may be adjusted with respect to the angle which support surface 32*a* makes with the support surface 28. Lock pin 50 preferably comprises a hexhead machine screw and is disposed in a recess 52*a* and projects through a bore 52*b* in boss 52. Lock pin 50 is threadedly connected to a knurled friction locknut 56, FIGS. 3 and 5, for locking the easel 32 in a preferred position with respect to the arm 34 and surface 28. As shown in FIG. 5, and also FIG. 6, a second boss 52 is supported on and fixed to easel 32 and is adapted to receive in its bore 53 a pivot pin 55 integrally formed on support arm 36. A second threaded lock pin 50 is disposed in an opposing recess 52*c* and bore 52*b* in the second boss 52 and is engageable with a second lock nut 56 for releasably locking the angular position of the easel 32 with respect to arm 36. Support arm 36, which is a mirror image of arm 34, includes an arcuate slot 48*a* defined by a boss 49*a*, as shown in FIG. 5, for receiving second lockpin 50.

Figure 6:
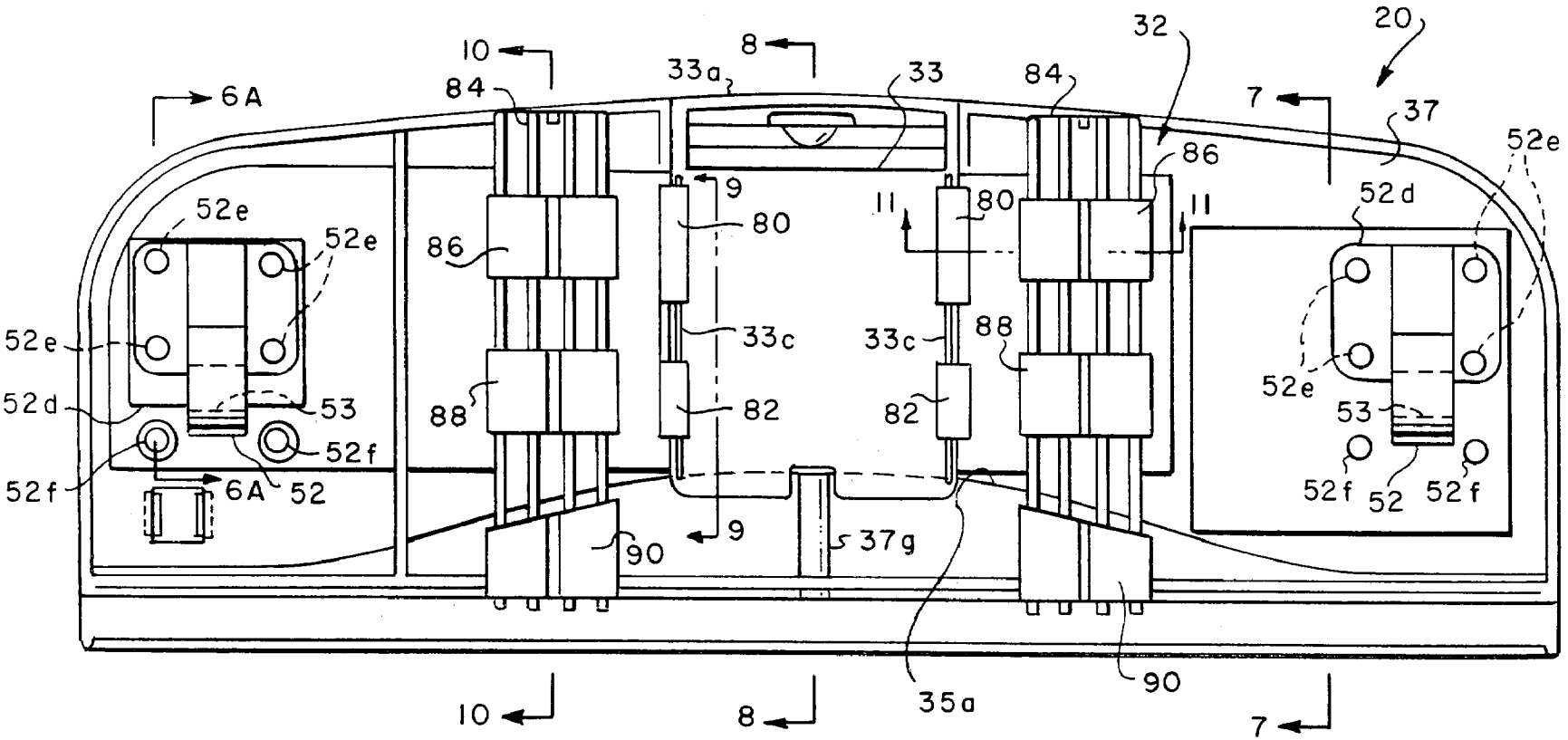
FIG. 6 is a rear elevation of the easel for the document holder shown in FIGS. 1 through 3 and taken generally from line 6—6 of FIG. 3.
Figure 6A:
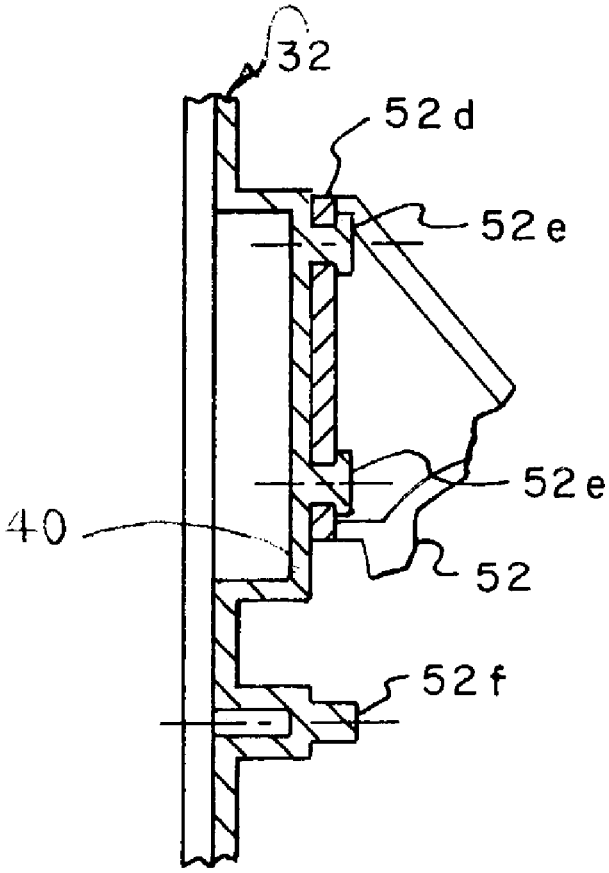
FIG. 6A is a section view taken generally along line 6A—6A of FIG. 6.
Figure 7:
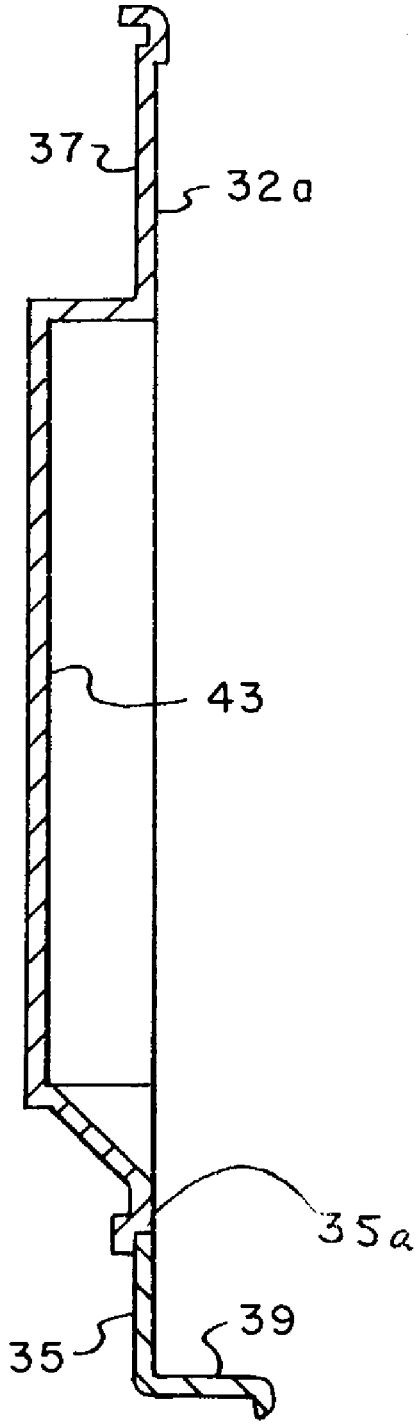
FIG. 7 is a section view taken generally along the line 7—7 of FIG. 6.

Referring briefly to FIGS. 6 and 6A, each of the bosses 52 includes a support flange 52*d* for mounting the bosses on the easel 32. As shown in FIGS. 6 and 6A, easel 32 is provided with two sets of four spaced apart support pins 52*e* which are disposed in a predetermined pattern and are operable to project into suitable pin receiving bores in flange 52*d* of the respective bosses 52. Two additional sets of support pins 52*f* are formed on easel 32, as shown, for supporting respective ones of the support brackets 52 at alternate positions, respectively, on easel 32. As shown in FIG. 6A, a boss 52 is mounted on easel 32 with its flange 52*d* receiving all four pins 52*e* in respective bores formed therein. Alternatively, boss 52 may be mounted on easel 32 with a set of two support pins 52*e* and a set of two support pins 52*f* projecting into the respective pin receiving bores of boss flange 52*d* for each of the bosses. In this way, the bosses 52 may be mounted in alternate positions on easel 32 for a purpose to be described in further detail herein. Moreover, the bosses 52 may be mounted in inverted positions with respect to the positions shown in FIGS. 3 and 6, also for a purpose to be described in further detail herein.

Referring again to FIGS. 3, 4 and 5, the arms 34 and 36 include elongated beam portions 34*a* and 36*a*, respectively, see FIGS. 4 and 5, and forwardly projecting support feet 34*b* and 36*b*. The arms 34 and 36 are each preferably integrally molded of a suitable plastic and are characterized by elongated hollow somewhat channel-shaped members having suitable truss-like reinforcement webbing 34*c*, FIG. 3, for example. Arms 34 and 36 are also preferably provided with friction pads or feet 63, see FIG. 3, by way of example, for assisting in retaining the document holder 20 in a preferred working position. Pads 63 are preferably formed of a suitable elastomer material having a relatively high coefficient of friction between the pads and conventional support surfaces. As shown in FIG. 4, the distal ends of the channel-shaped beam portions of arms 34*a* and 36*a* support suitable counterweights 68 therein to resist tipping of the document holder 20 forwardly or somewhat clockwise, viewing FIG. 3. Accordingly, easel 32 is adjustable about a horizontal pivot axis 70, FIGS. 3 and 5, formed by bosses 52 and pins 54 and 55, and may be easily locked in a suitable working position by the opposed lock pins 50 and lock nuts 56 which may be easily manually tightened and loosened for purposes of rotating the easel 32 to a desired working position.

Figure 8:
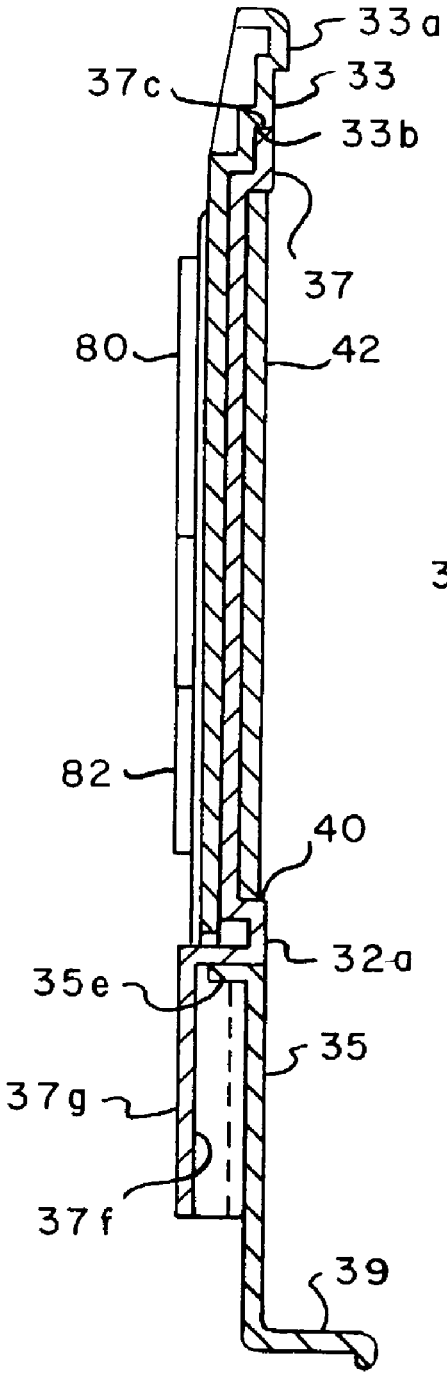
FIG. 8 is a section view taken generally along the line 8—8 of FIG. 6.
Figure 9:
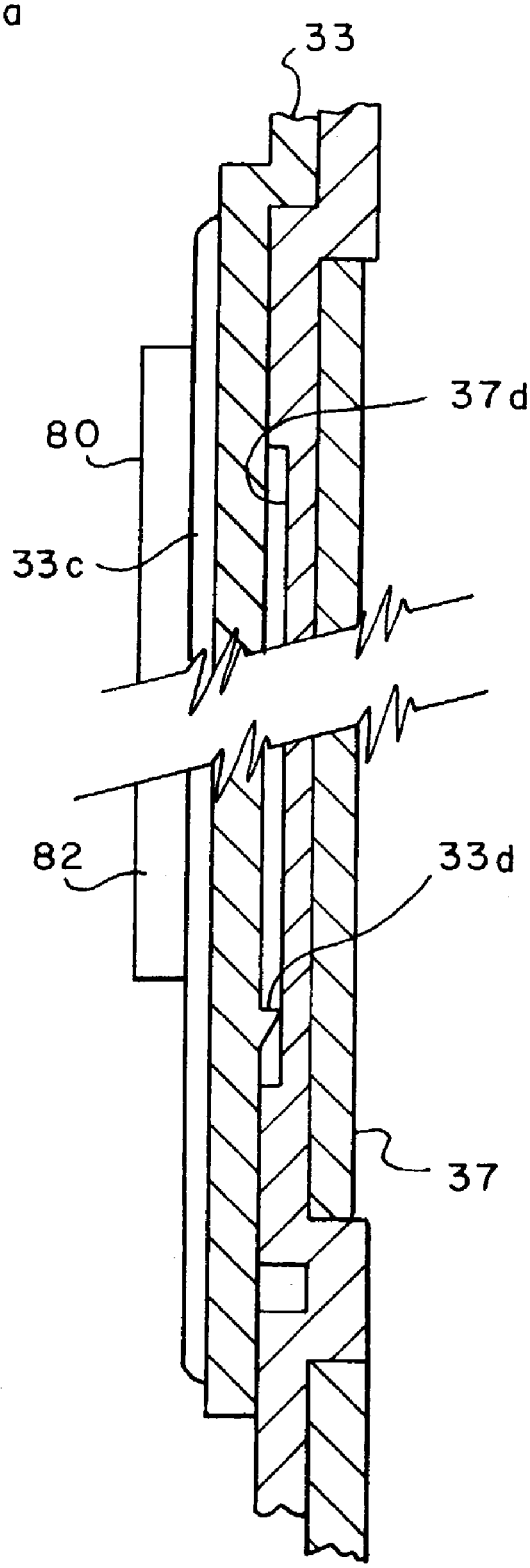
FIG. 9 is a section view taken generally along the line 9—9 of FIG. 6.
Figure 11:
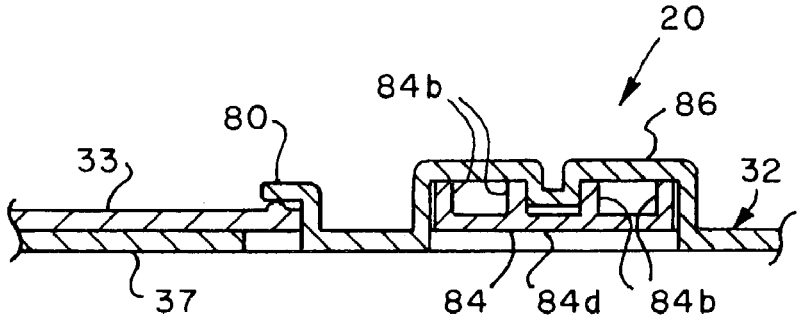
FIG. 11 is a section view taken along the line 11—11 of FIG. 6.

Referring again to FIG. 6, which is a rear elevation of the easel 32 with the arms 34 and 36 not shown, the upwardly movable easel member 33 is shown retained slidably on easel member 37 between opposed spaced apart retainer members 80 and 82, see FIGS. 9 and 11 also. Movable easel member 33 includes a transverse upper edge 33*a* below which a first shoulder 33*b* is formed, see FIG. 8, and which is engageable with easel member 37 in a retracted position of the easel member 33. As shown in FIG. 2, stepped upper edge 33*a* of easel member 33 fits in a slot or notch 37*c* formed in the upper edge of easel member 37 and the stepped upper edge of easel member 33 provides a "handle" for ease of sliding the easel member 33 between extended and retracted positions.

As shown in FIG. 9, easel member 33 also includes spaced apart elongated integrally formed friction rails 33*c*, see FIG. 6 also, engageable with retainer members 80 and 82 to provide a slidable but friction lock type fit between the easel members 33 and 37 and retainer members 80 and 82. Upward extension of easel member 33 with respect to easel member 37 is limited by spaced apart stop projections 33*d*, one shown in FIG. 9, which are slidably disposed in elongated recesses 37*d*, one shown also in FIG. 9.

Figure 10:
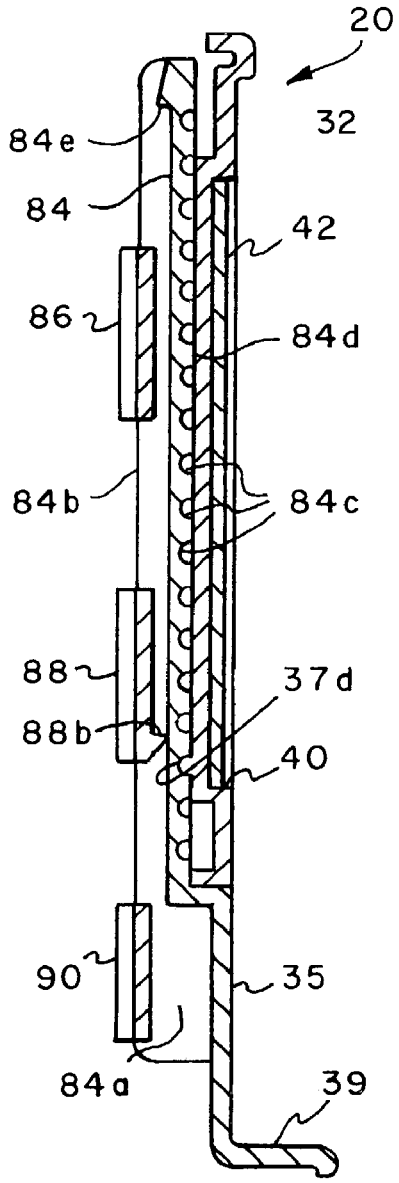
FIG. 10 is a section view taken generally along the line 10—10 of FIG. 6.

Referring further to FIG. 6, as well as FIGS. 8 and 10, downwardly extendable easel member 35 is coextensive, side-to-side, with easel member 37 and includes an upwardly projecting arcuate portion 35*a*, see FIG. 2 also, which fits in a cooperating recess 37*e*, FIG. 2, formed in easel member 37. As shown in FIGS. 6 and 10, easel member 37 is provided with spaced apart upwardly projecting elongated support rail members 84 which are integrally formed with easel member 35 at their lower ends 84*a*, FIG. 10, and are slidably retained in spaced apart somewhat channel-shaped retainer members 86, 88 and 90 which are integrally formed with the easel member 37, see FIG. 6 also. The cross sectional configuration of the channel-shaped retainers 86, 88 and 90 is shown by way of example for retainer member 86, as shown in FIG. 11. In this regard also each of the support rail members 84 is provided with spaced apart elongated parallel flanges 84*b* which cooperate with the retainer members 86, 88 and 90, as shown in FIG. 11, to snugly but slidably guide the movable easel member 35 with respect to the easel member 37.

As shown by way of example in FIG. 10, each of the elongated support rail members 84 includes spaced apart detent recesses 84*c* formed in the surface 84*d* of the support member 84 which faces a cooperating surface of easel member 37. Easel member 37 includes a projection or detent part 37*d*, FIG. 10 which cooperates with the recesses 84*c* to retain the easel member 35 in a selected extended or retracted position with respect to easel member 37, but the support rail members 84 and easel member 35 may be moved to a selected working position wherein a selected one of the recesses 84*c* receive the detent or projection 37*d*, respectively.

A downwardly extended limit position of easel member 35 is provided by a stop projection 84*e*, FIG. 10, which is engageable with a cooperating projection 88*b* formed on retainer member 88, as shown. Each of members 84 is provided with the spaced apart detent recesses 84*c* and a stop projection 84*e*, as shown by way of example in FIG. 10. Of course, easel member 37 is provided with respective spaced apart projections 37*d* and 88*b* for cooperation with each of the support rail members 84. As further shown in FIGS. 6 and 8, easel member 35 may include a molding gate projection 35*e*, FIG. 8, which is disposed in a slot 37*f* formed in a channel-shaped portion 37*g*, FIGS. 6 and 8, of member 37.

Figure 12:
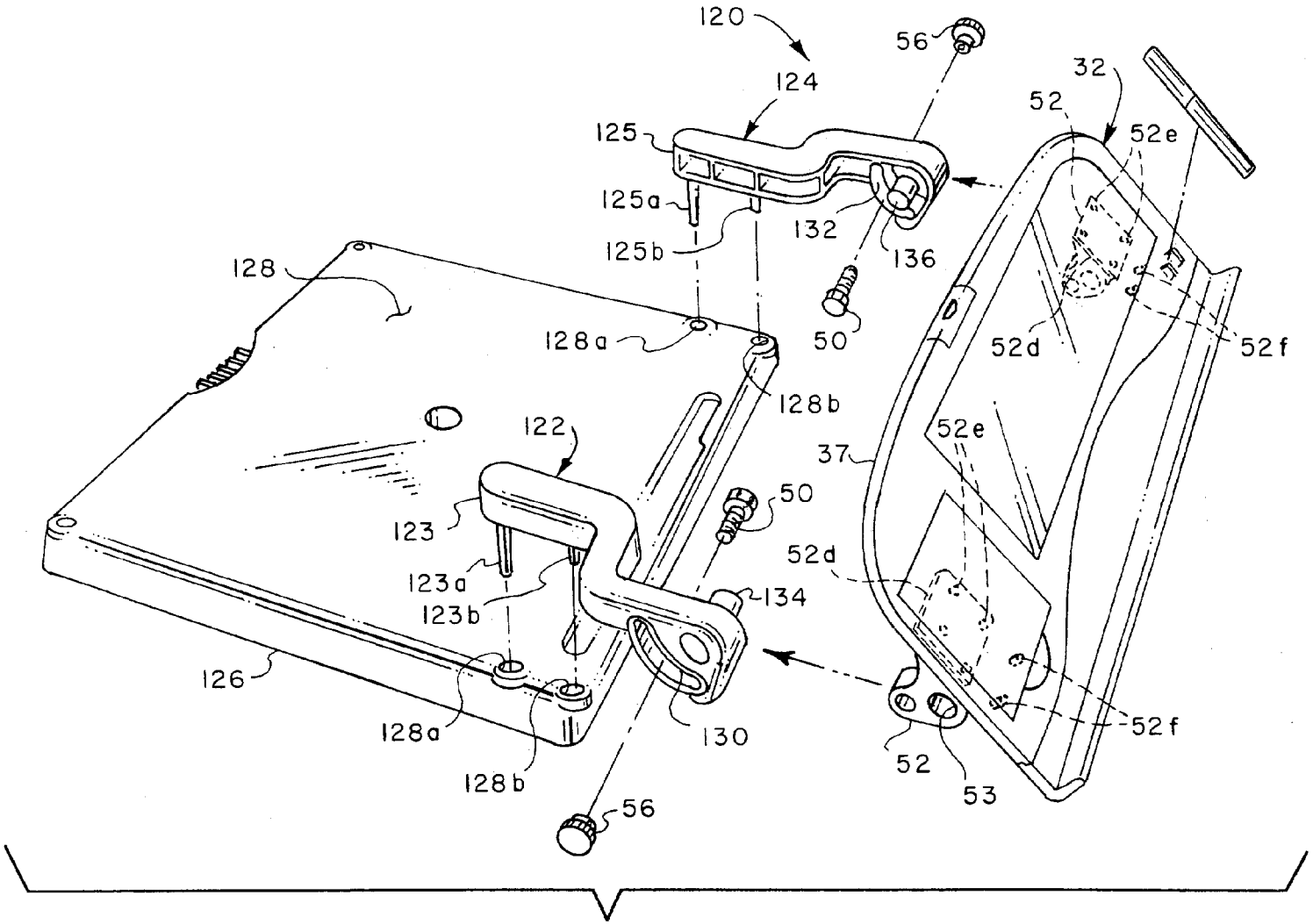
FIG. 12 is an exploded perspective view of a first alternate embodiment of a document holder in accordance with the invention.

Referring now to FIG. 12, there is illustrated a first alternate embodiment of the present invention comprising a document holder generally designated by the numeral 120. The document holder 120 includes the easel 32 connected to spaced apart bosses 52 wherein the bosses 52 have been connected to the easel member 37 in the same position as for the document holder 20. The document holder 120 includes spaced apart support arms 122 and 124 which have offset arm portions 123 and 125, respectively. Arms 122 and 124 are also provided with depending support pins 123*a*, 123*b* and 125*a*, 125*b*, respectively. Arms 122 and 124 are adapted to be supported on a pedestal 126 which includes a horizontal top wall 128 in which suitable openings 128*a* and 128*b* are formed for receiving the respective support pins for the arms 122 and 124, as shown in FIG. 12.

Referring further to FIG. 12, the arms 122 and 124 include respective arcuate slots 130 and 132 formed therein and corresponding to the slots 48 and 48*a* formed in the arms 34 and 36, respectively. Moreover, the arms 122 and 124 also include respective bearing or pivot pins 134 and 136 operable to project into the bores 53 of the respective bosses 52. Lock pin and nut assemblies 50, 56, are operable to be connected to the bosses 52, as previously described, and project through the slots 130 and 132 of the arms 122 and 124 to lock the easel 32 in a selected angular position with respect to the arms 122, 124 and with respect to the pedestal 126. Accordingly, the embodiment shown in FIG. 12 is adapted to be supported on a pedestal for a computer monitor or the like, not shown, while enjoying all of the benefits of the present invention.

Figure 13:
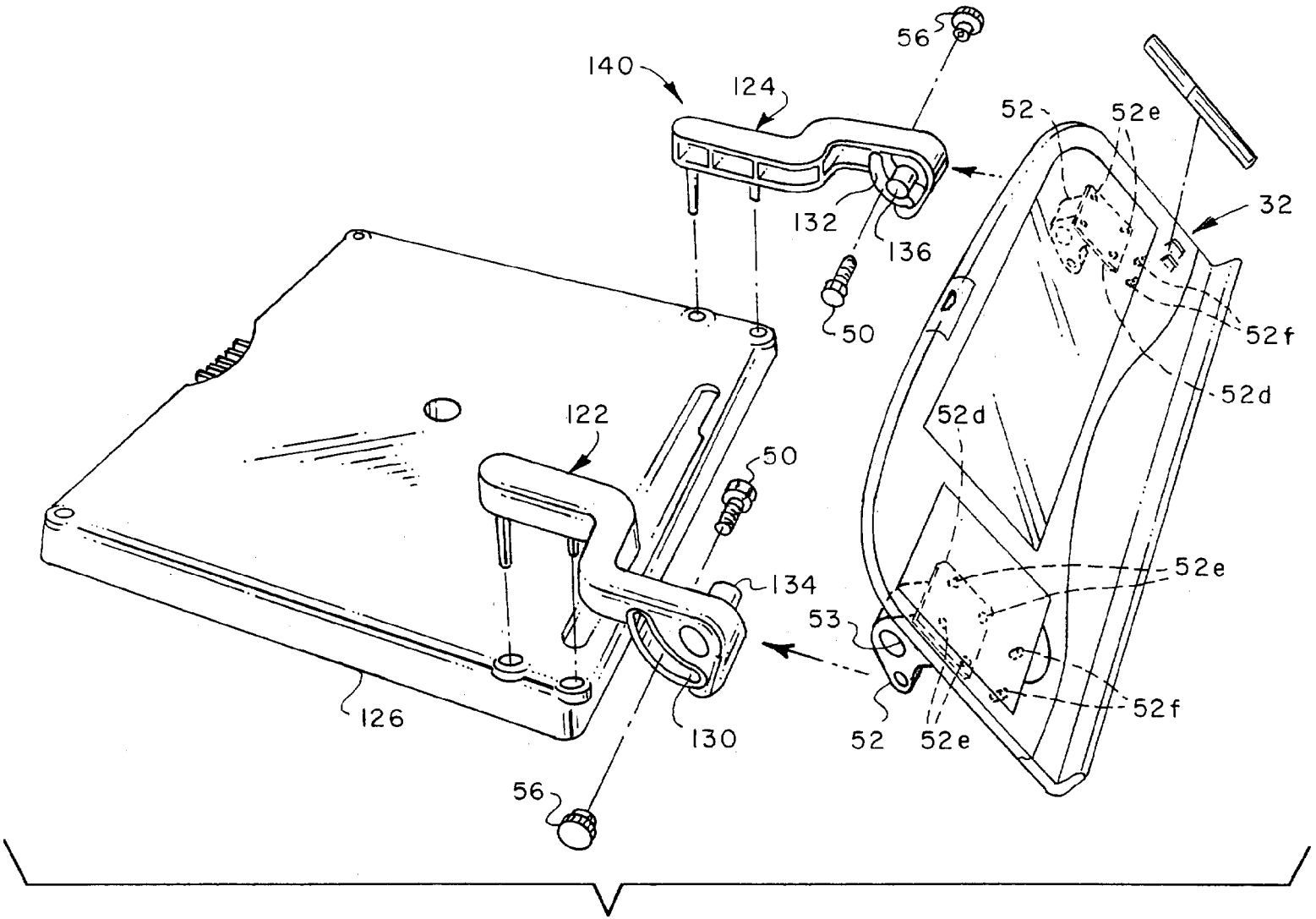
FIG. 13 is an exploded perspective view of a second alternate embodiment of a document holder in accordance with the invention.

Referring now to FIG. 13, a second alternate embodiment of the present invention is illustrated and generally designated by the numeral 140. The document holder 140 is substantially like the document holder 120 except that the easel 32 is modified to provide for mounting the bosses 52 thereon in a position inverted with respect to the bosses as they are oriented for the documents holders 20 and 120. In all other respects, the document holder 140 is essentially like the document holder 120.

Figure 14:
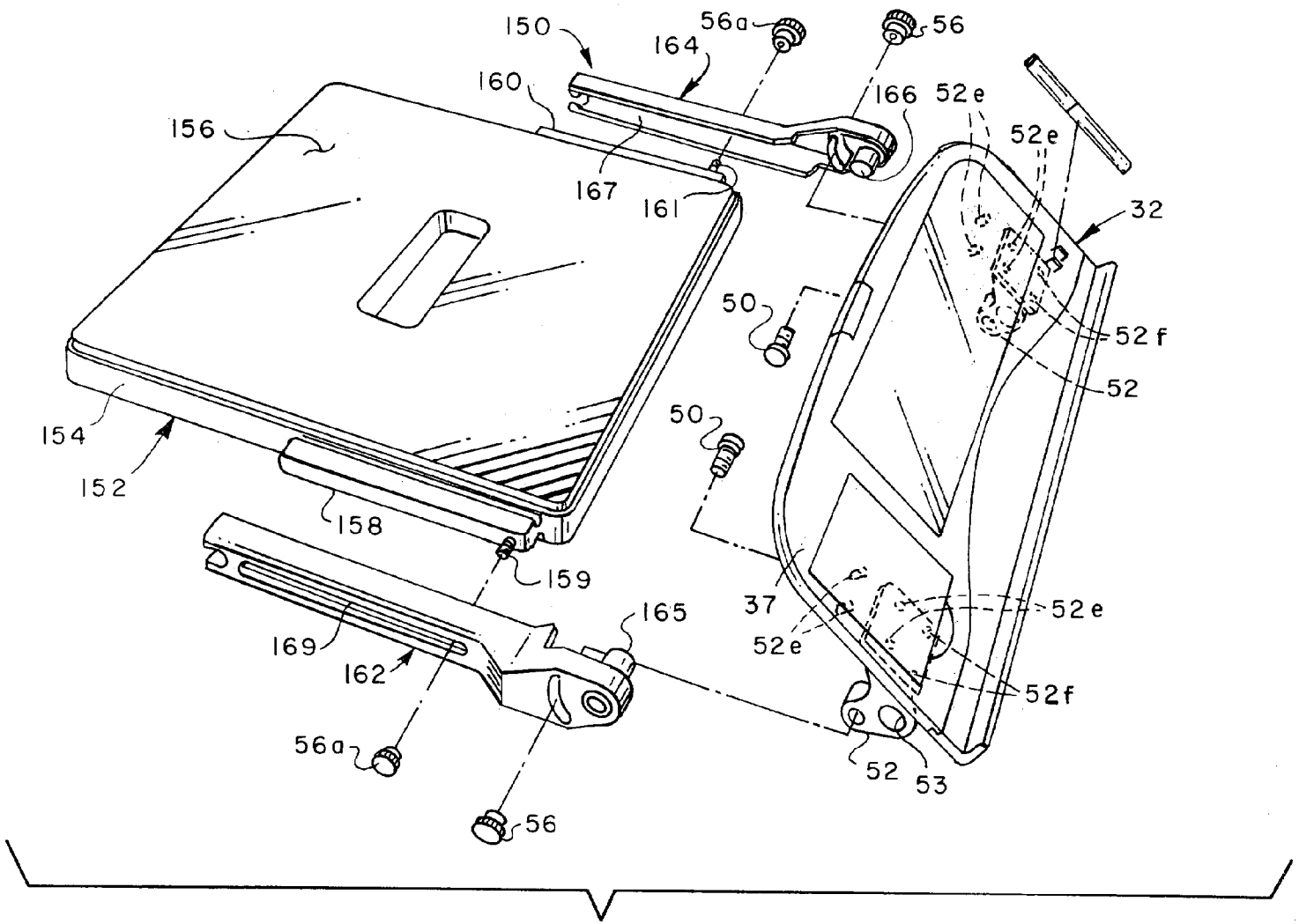
FIG. 14 is an exploded perspective view of a third alternate embodiment of the document holder of the present invention.

Referring now to FIG. 14, a third alternate embodiment of the present invention is illustrated and generally designated by the numeral 150. The document holder 150 includes an easel member 32 and support brackets or bosses 52 oriented in the same direction as with the document holders 20 and 120 but connected to the easel member 37 at the respective lower sets of pins 52*f* and the intermediate sets of pins 52*e*, thus leaving the upper sets of pins 52*e* unused. In this way, the easel 32 may be mounted at a higher elevation with respect to its support structure.

As further shown in FIG. 14, the document holder 150 is particularly adapted to be supported on a generally rectangular pedestal 152 having a peripheral substantially vertical sidewall 154, a generally horizontal and planar top wall 156 and opposed, elongated support rails 158 and 160 which extend generally parallel to each other on opposite parallel sides of the peripheral wall 154. Threaded support posts 159 and 161 project laterally outward from the rails 158 and 160, respectively, as illustrated. Document holder 150 further includes opposed elongated support arms 162 and 164 which are substantially identical mirror image parts and are provided with bearing bosses 165 and 166, respectively, operable to project into the bearing bores 53 of the respective bosses 52 and be secured thereto by the pin and nut assemblies 50, 56. This arrangement allows pivotal adjustment of the easel member 32 with respect to the support arms 162 and 164 and pedestal 152 in substantially the same manner that the easel member 32 is angularly adjustable with respect to the support arms 122 and 124 of the document holder 120, as well as the support arms 34 and 36 of the document holder 20. However, support arms 162 and 164 are each provided with elongated channel shaped recesses, such as the recess 167 shown for arm 164, together with a post receiving slot, such as the slot 169 shown for the arm 162, whereby the respective arms 162 and 164 may be supported on the rails 158 and 160, respectively, and adjustably secured thereto by knurled lock nuts 56*a* which are operable to be threadedly connected to the posts 159 and 161, respectively. Accordingly, the document holder 150 enjoys generally horizontal or lateral adjustment with respect to pedestal 152 and a computer monitor, not shown, supported thereon, as well as enjoying the other benefits of the invention.

The support arms 34, 36, 122, 124, 162 and 164, the easel members 33, 35 and 37 and the bosses 52 may all be separately fabricated of injection molded plastic, such as high impact polystyrene. The bosses 52 may then be assembled and secured to the easel member 37 in their respective selected working positions by suitable "welding" processes, for example. The easel members 33 and 35 may be assembled to the easel member 37 by "snap together" operations, since the dimensions of the respective retainers on easel member 37 are predetermined to cooperate with easel members 33 and 35 to allow assembly and disassembly by elastic deflection of the respective parts with respect to each other. However, on assembly of the easel members 33 and 35 to the easel member 37 the cooperating parts described above, normally, limit the extension and retraction of the easel member 33 and 35 with respect to the easel member 37 and holding of the easel members fixed relative to each other during normal or intended use.

The construction and operation of the document holders 20, 120, 140 and 150 is believed to be readily understandable to those of ordinary skill in the art based on the foregoing description. Those skilled in the art will also appreciate from the foregoing that the document holder 20 utilizes space normally available at a computer workstation or a word processing unit in an improved manner.

Regardless of whether or not the workstation includes a keyboard tray, utilizes split surface furniture, or the monitor is mounted on a tower or merely a desktop, the document holders of the present invention can adjust to all of these situations thanks at least in part to the adjustable easel 32 wherein the easel document support surface 32*a* may be adjusted with regard to the angle the document support surface makes with respect to a workstation operator. Moreover, the multipart easel 32 may be adjusted to accommodate documents of various sizes and to move a document into a preferred position with respect to the operator of the equipment in connection with which the document holder is being used.

Although preferred embodiments of the invention have been described in detail herein, those skilled in the art will recognize that various substitutions and modifications may be made to the invention without departing from the scope and spirit of the appended claims.

What is claimed is:

1. A document holder for use with a computer keyboard and video monitor unit, said document holder comprising:

a document support easel comprising a first easel member having a planar document support surface and opposed upper and lower edges, and a second easel member having a document support surface and a transverse document support flange, said second easel member being connected to said first easel member by cooperating support parts for supporting said second easel member in a selected working position and being movable in a direction generally downwardly with respect to said first easel member away from said lower edge of said first easel member to provide for supporting a document in a selected position of said document with respect to said keyboard, said first easel member is supported by spaced apart substantially parallel support arms and said first easel member and said support arms include cooperating pivot means formed on respective bosses on said first easel member and said support arms, respectively, for supporting said easel for angular adjustment with respect to said support arms, and said support arms include elongated beam portions extending in one direction from said bosses on said support arms, respectively, and separate counterweight members disposed on said beam portions, respectively, and spaced from the point of connection of said support arms to said first easel member for stabilizing the support of said first easel member on a substantially horizontal support surface, said support arms including respective foot portions extending in an opposite direction from said bosses on said support arms for supporting said document support easel solely by said support arms on said substantially horizontal support surface.

2. The document holder set forth in claim 1 including:

lock members disposed on said bosses on said first easel member and engageable with said support arms for locking said first easel member in a selected angular position with respect to said support arms.

3. The document holder set forth in claim 2 wherein:

said first easel member and said bosses on said first easel member include cooperating support parts for locating said bosses on said first easel member in at least two selected working positions with respect to said first easel member.

4. The document holder set forth in claim 1 wherein:

said second easel member includes spaced apart elongated support rail members engageable with cooperating retainers formed on said first easel member and said first easel member and said second easel member include cooperating detent means for holding said second easel member in a selected working position with respect to said first easel member.

5. The document holder set forth in claim 4 wherein:

each of said support rails includes spaced apart detent recesses formed thereon and said first easel member includes cooperating detent projections formed thereon and engageable with said support rails at said recesses, respectively.

6. The document holder set forth in claim 1 including:

cooperating stop means formed on said first and second easel members for limiting an extended position of said second easel member with respect to said first easel member.

7. The document holder set forth in claim 1 including:

a third easel member supported on said first easel member adjacent said upper edge of said first easel member and operable to be moved to a selected working position in a direction opposite a position of said second easel member to aid in supporting a document on said easel.

8. The document holder set forth in claim 7 wherein:

said first and third easel members include cooperating stop means for limiting movement of said third easel member with respect to said first easel member.

9. The document holder set forth in claim 1 wherein:

said easel includes a recess in said document support surface of said first easel member for receiving a notepad facing an operator of said document holder for access to said notepad.

10. The document holder set forth in claim 1 wherein:

said first easel member includes a member formed thereon providing an erasable writing surface facing an operator of said document holder.

* * * * *